US006073679A

United States Patent [19]

Strezov

[11] Patent Number: 6,073,679

[45] **Date of Patent: *Jun. 13, 2000**

[54] CASTING STEEL STRIP

[75] Inventor: Lazar Strezov, Adamstown, Australia

[73] Assignees: Ishikawajima-Harima Heavy Industries Ltd. Company Limited, Tokyo, Japan; BHP Steel (JLA) Pty. Ltd., Melbourne, Australia

[ * ] Notice: This patent is subject to a terminal disclaimer.

[21] Appl. No.: 08/913,818

[22] PCT Filed: Apr. 29, 1996

[86] PCT No.: PCT/AU96/00244

§ 371 Date: Sep. 24, 1997

§ 102(e) Date: Sep. 24, 1997

[87] PCT Pub. No.: WO96/34709

PCT Pub. Date: Nov. 7, 1996

[30] Foreign Application Priority Data

May 5, 1995 [AU] Australia ..... PN2811
Aug. 11, 1995 [AU] Australia ..... PN4748

[51] Int. Cl.[7] ..... B22D 11/06; B22D 11/10

[52] U.S. Cl. ..... 164/473; 164/459; 164/480

[58] Field of Search ..... 164/480, 428, 164/459, 488, 473

[56] References Cited

U.S. PATENT DOCUMENTS 5,345,994 9/1994 Kato et al. ..... 164/480
5,701,948 12/1997 Strezov et al. ..... 164/480

OTHER PUBLICATIONS

Derwent Abstract Accession No. 90–330626/14, Class P53, JP 02–236254 A (Nippon Steel Corp.) Sep. 19, 1990.

Derwent Abstract Accession No. 89–367752/50, Class M27, JP 01–275736 A (Nippon Steel Corp.) Nov. 6, 1989.

Derwent WPAT Online Accession No. 02022Y/02, BE 844818 A (Centro Speri Metal Spa) Dec. 1, 1976.

Patent Abstracts of Japan, M138, p. 74, JP 57–41847 A, (Sumitomo Kinzoku Kogyo KK) Jan. 30, 1992.

Patent Abstracts of Japan, C57, p. 24, JP 56–29658 A, (Kawasaki Seitetsu KK) Mar. 25, 1981.

Patent Abstracts of Japan, C715, p. 50, JP 02–47242 A (Kobe Steel Ltd) Feb. 16, 1990.

Patent Abstracts of Japan, C273, p. 9, JP 59–205453 A (Daido Tokushuko KK).

*Primary Examiner*—Kuang Y. Lin

*Attorney, Agent, or Firm*—Miles & Stockbridge P.C.; John C. Kerins

[57] ABSTRACT

Continuous casting of steel strip in twin-roll caster comprises casting rolls (16). Molten steel is delivered by a delivery system and comprising delivery nozzle (19*b*) to casting pool (30) supported above nip (10) between the casting rolls (16) which are rotated to deliver a solidified strip (20) downwardly from the nip. To avoid dissolution of carbon from refractories of the metal delivery system including the nozzle (19*b*), the molten steel is a silicon/manganese killed carbon steel having a manganese content of not less than 0.02% by weight, a silicon content of not less than 0.10% by weight, an aluminium content of less than 0.01% by weight and a sulphur content of at least 0.02% by weight. The required sulphur content of the steel may be achieved by addition of iron sulphide to a batch of steel in a tundish (18) of the delivery system.

20 Claims, 1 Drawing Sheet

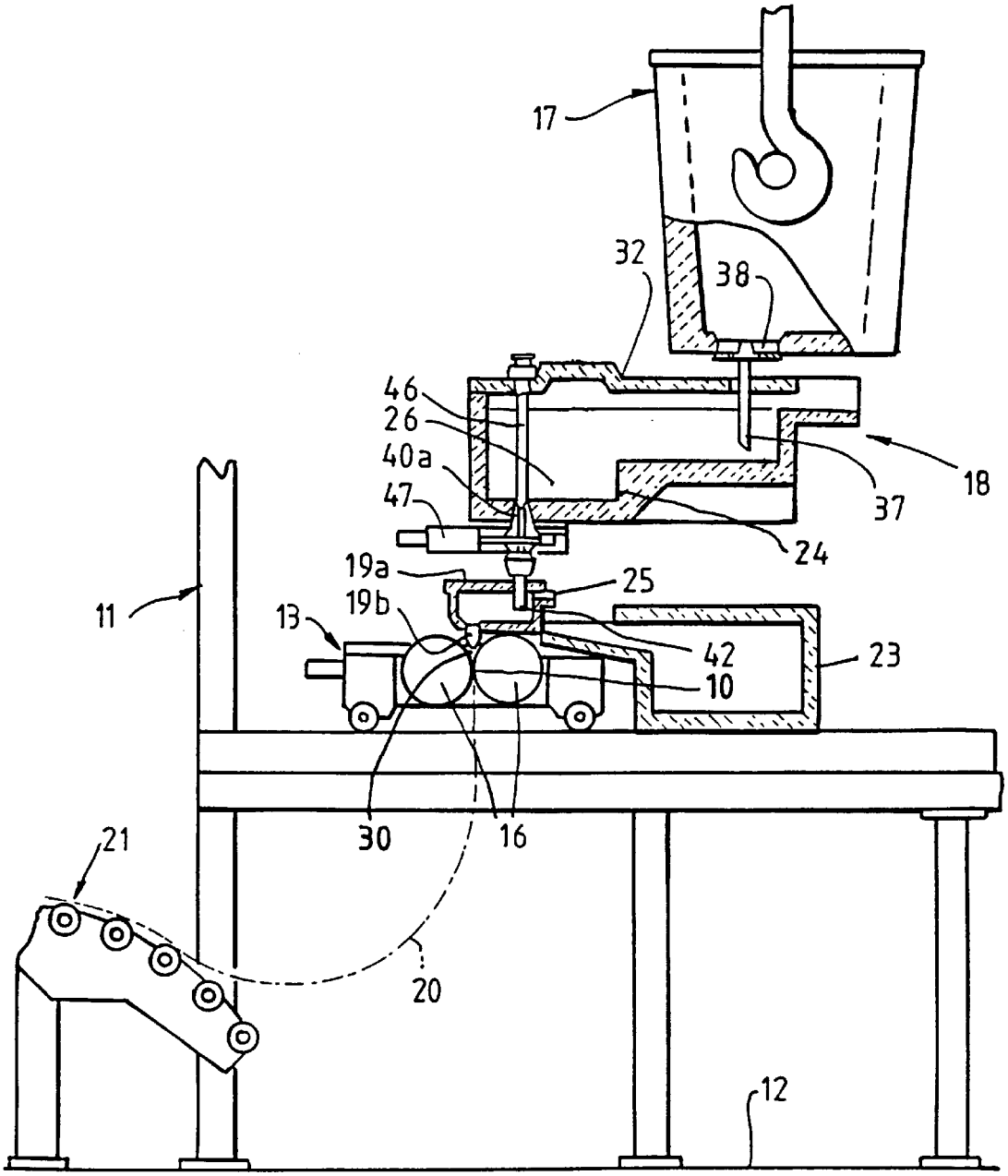
17
32
38
46
26
40a
47
18
37
24
19a
25
11
19b
13
42
23
10
30
16
21
20
12

CASTING STEEL STRIP

TECHNICAL FIELD

This invention relates to the casting of steel strip.

It is known to cast metal strip by continuous casting in a twin roll caster. In this technique molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electromagnetic barriers have also been proposed.

Although twin roll casting has been applied with some success to non-ferrous metals which solidify rapidly on cooling, there have been problems in applying the technique to the casting of ferrous metals. One particular problem encountered in the casting of mild steel in a twin roll strip caster is the propensity for molten mild steel to produce solid inclusions, in particular inclusions which contain aluminates, and these solid inclusions clog the very small metal flow passages required in the metal delivery system of a twin roll caster. As fully described in our New Zealand Patent Application 270147 we have determined by an extensive programme of strip casting various grades of steel in a twin roll caster that aluminium killed mild steels or partially killed mild steel, with an aluminium residual content of 0.01% or greater cannot be cast satisfactorily because the solid inclusions agglomerate and clog the fine flow passages in the metal delivery system to form defects and discontinuties in the resulting strip product. This problem can be overcome by keeping the aluminium content below 0.01% by weight and by using a silicon/manganese killed steel having a manganese content of not less than 0.20% by weight and a silicon content of not less than 0.02% by weight. However, such silicon/manganese killed steels have a very much higher oxygen content than aluminium killed steels and this gives rise to a problem of carbon dissolution from the refractories of the metal delivery system. Specifically, the carbon combines with oxygen from the molten steel to produce carbon monoxide. This can degrade the surfaces of the fine flow passages in the delivery nozzle. Moreover, in casters in which the delivery nozzle dips into the casting pool, the pool is disturbed by carbon monoxide bubbles generated by the reaction between carbon in the submerged delivery nozzle and oxygen in the molten metal of the casting pool.

Silicon/manganese killed steels will have an oxygen content in the range 50–155 ppm at typical casting temperatures of the order of 1600–1700° C. whereas the oxygen content of aluminium killed steels will generally be less than 10 ppm and the carbon leaching problem is a very significant one when endeavouring to cast silicon/manganese killed steel.

We have now determined that this problem can be solved by the controlled addition of sulphur to the silicon/manganese killed steel melt at least in the start-up phase of a casting operation. After start-up a surface slag forms on the delivery nozzle which is dipped into the casting pool. This slag reduces the availability of carbon to react with the oxygen in the immersed areas of the delivery nozzle which is the part of the metal delivery system most vulnerable to carbon leaching.

The addition of sulphur also enables the avoidance of "chatter" and "crocodile skin" defects in the strip due to heat flux irregularities as fully explained in our co-pending Australian Patent Application PN2811.

DISCLOSURE OF THE INVENTION

According to the invention there is provided a method of continuously casting steel strip of the kind in which molten metal is introduced into the nip between a pair of parallel casting rolls via a metal delivery system to create a casting pool of molten metal supported on casting surfaces of the rolls immediately above the nip and the casting rolls are rotated to deliver a solidified steel strip downwardly from the nip, wherein the metal delivery system comprises a metal delivery nozzle consisting of refractory material containing carbon which is located above the nip between the casting rolls so as to deliver molten metal into the nip, wherein a lower part of the delivery nozzle is submerged in the casting pool during casting and wherein said steel is a silicon/manganese killed carbon steel having a manganese content of not less than 0.20%, a silicon content of not less than 0.10% by weight, an aluminium content of less than 0.01% by weight and a sulphur content of at least 0.02% by weight.

Preferably the aluminium content of the steel is no greater than 0.005% and the sulphur content is in the range 0.03 to 0.05% by weight.

The required sulphur content of the steel may be achieved by addition of iron sulphide to the molten metal in the delivery system.

Preferably the metal delivery system comprises a tundish and said addition of iron sulphide is made in the tundish.

More preferably, such addition is made prior to casting to a batch of molten metal in the tundish.

After casting an initial length of strip from the said batch of molten metal, casting may be continued by supply of further molten metal, such further molten metal having a lower sulphur content, so as to produce a length of strip steel contiguous with said initial length but having a lower sulphur content.

Said batch of molten steel may be in the range of 1 to 6 tonnes.

Said refractory material may be comprised of graphitised alumina.

BRIEF DESCRIPTION OF THE DRAWING

In order that the invention may be more fully explained one particular apparatus for performance of the invention will be described with reference to the accompany drawing which is a partly sectioned side-elevation of a strip caster.

DETAILED DESCRIPTION OF THE PREPARED EMBODIMENT

The illustrated caster comprises a main machine frame generally identified by the numeral 11, which stands up from the factory floor 12. Frame 11 supports a casting roll carriage 13 which is horizontally movable between an assembly station and a casting station. Carriage 13 carries a pair of parallel casting rolls 16 which form a nip (10) in which a casting pool (30) of molten metal is formed and retained between two side plates or dams (not shown) held in sliding engagement with the ends of the rolls.

Molten metal is supplied during a casting operation from a ladle 17 via a tundish 18, delivery distributor 19*a* and delivery nozzle 19*b* into the casting pool. Casting rolls are water cooled so that molten metal from the casting pool solidifies as shells on the moving roll surfaces and the shells are brought together at the nip between them to produce a solidified strip product 20 at the roll outlet. This product is fed to a run out table 21 and subsequently to a standard coiler.

Tundish 18 is fitted with a lid 32 and its floor is stepped at 24 so as to form a recess or well 26 in the bottom of the tundish at its left-hand end. Molten metal is introduced into the right-hand end of the tundish from the ladle 17 via an outlet nozzle 37 and slide gate valve 38. At the bottom of well 26, there is an outlet 40 in the floor of the tundish to allow molten metal to flow from the tundish via an outlet nozzle 42 to the delivery distributor 19*a* and the nozzle 19*b*. The tundish 18 is fitted with a stopper rod 46 and slide gate valve 47 to selectively open and close the outlet 40 and effectively control the flow of metal through the outlet.

In accordance with the present invention tundish 18 is able to hold an initial batch of molten metal of increased sulphur content. This may be achieved by simple addition of iron sulphide to the tundish before pouring from the ladle 17. Typically, an initial batch of silicon/manganese killed carbon steel of the order of 4 tonnes is adjusted to have a sulphur content in the range 0.03 to 0.05% by weight.

The initial batch of high sulphur content steel is then cast to produce a high sulphur content initial length of strip. Such casting may typically proceed for about 2 to 4 minutes. When stable casting has been established and a layer of slag has been formed on the delivery nozzle 19*b* which is immersed in the casting pool, further molten metal is poured from the ladle into the tundish without sulphur addition so as to fill the tundish and to maintain a full tundish as casting proceeds whereby to produce a length of lower sulphur content steel contiguous with the initial length.

Metal delivery nozzle 19*b* may be made of alumina graphite. Typically, it may comprise of the order of 58% $Al_2O_3$, 32% carbon and 5% $ZrO_2$. Without the sulphur addition on start-up, it has been found that the high oxygen content of the silicon/manganese killed steel causes leaching of carbon from this refractory material to produce carbon monoxide bubbles in the casting pool and to erode the galleries and passageways in the delivery nozzle. More particularly, ferrous oxide in the slag reacts with carbon to produce carbon monoxide and iron. X-ray mapping of the slag adjacent the refractory surfaces that have been immersed in the casting pool shows that the ferrous oxide content of the slag is reduced toward the refractory surface and carbon monoxide bubbles are clearly seen in the slag. This demonstrates that ferrous oxide in the regions of the melt adjacent the refractory surface reacts with carbon in the refractory to generate the carbon monoxide bubbles. The presence of sulphur reduces wetting between the steel and the refractory surfaces and therefore reduces exposure of the carbon in the refractory to the oxygen in the steel melt. Moreover, sulphur is strongly surface active and reacts with iron in the melt to form ferrous sulphide in preference to the formation of ferrous oxide. This reaction produces oxygen which remains dissolved in the steel and cannot readily react with carbon in the nozzle refractory material.

It has been found that a silicon/manganese killed steel can be cast satisfactorily without carbon leaching from the delivery system refractory material if the steel has the following composition by weight:

| | |
|---|---|
| Carbon | 0.04–0.08% |
| Manganese | 0.50–0.70% |
| Silicon | 0.20–0.40% |
| Sulphur | 0.03–0.05% |
| Aluminium | less than 0.01% |

A preferred composition is as follows:

| | |
|---|---|
| Carbon | 0.06% |
| Manganese | 0.66% |
| Silicon | 0.32% |
| Sulphur | 0.04% |

Total oxygen content 60 ppm @ 1600° C.

It has been found that after casting has been established and a slag has been built up on the delivery nozzle the problem of carbon leaching from the refractory of the delivery nozzle is very much reduced. The slag contains a complex of silicon, manganese and aluminium oxides which reduces the availability of ferrous oxide to react with carbon in the refractory material. A high sulphur content in the strip may lead to low melting strength giving rise to hot shortness and cracking problems in applications where the as cast strip is subsequently reheated up to temperatures above 900° C. for periods of time which allow substantial oxidation to occur. In such applications it will be desirable to reduce the sulphur content of the metal being cast to less than 0.01% once stable casting conditions have been achieved and a suitably thick layer of slag has been generated.

I claim:

1. A method for continuously casting steel strip comprising:

introducing a molten silicon/manganese killed carbon steel having a manganese content of not less than 0.20% by weight, a silicon content of not less than 0.10% by weight, a sulphur content of less than 0.02% by weight, and an aluminum content of less than 0.01% by weight, into a metal delivery system comprising a metal delivery nozzle, said metal delivery nozzle consisting of refractory material containing carbon;

delivering molten metal through said metal delivery nozzle into a nip between a pair of casting rolls to create a casting pool of molten metal supported on casting surfaces of the rolls immediately above the nip, said molten metal delivery being at a sufficient delivery rate that a lower part of the metal delivery nozzle becomes submerged in said casting pool during casting; and during a predetermined startup casting period only, providing a sulphur addition such that the sulphur content of the molten steel is at least 0.02% by weight.

2. A method as claimed in claim 1, wherein the aluminium content of the steel is no greater than 0.005% and the sulphur content is in the range 0.03 to 0.05% by weight.

3. A method as claimed in claim 1 wherein said step of adding sulphur comprises adding a metal sulphide to the molten metal in the delivery system.

4. A method as claimed in claim 3, wherein said metal sulphide is iron sulphide.

5. A method as claimed in claim 3 wherein the metal delivery system further comprises a tundish (18) and said step of adding said metal sulphide further comprises adding said metal sulphide to a batch of molten metal in the tundish (18) prior to casting.

6. A method as claimed in claim 5, wherein the process further comprises casting an initial length of the strip (20) from said batch of molten metal containing the sulphide addition, whereafter casting is continued without interruption by supply of further molten metal and without said sulphide addition, such further molten metal having a lower sulphur content than said batch, thereby casting a further length of strip steel contiguous with said initial length but having a lower sulphur content.

7. A method as claimed in claim 5, wherein said batch of molten steel is in the range of 1 to 6 tonnes.

8. A method as claimed in claim 1, wherein said refractory comprises graphitised alumina.

9. A method as claimed in claim 2, wherein said step of adding sulphur comprises adding a metal sulphide to the molten metal in the delivery system.

10. A method as claimed in claim 9, wherein said metal sulphide is iron sulphide.

11. A method as claimed in claim 4, wherein the metal delivery system further comprises a tundish and said step of adding said metal sulphide further comprises adding said metal sulphide to a batch of molten metal in the tundish prior to casting.

12. A method as claimed in claim 9, wherein the metal delivery system further comprises a tundish and said step of adding said metal sulphide further comprises adding said metal sulphide to a batch of molten metal in the tundish prior to casting.

13. A method as claimed in claim 10, wherein the metal delivery system further comprises a tundish and said step of adding said metal sulphide further comprises adding said metal sulphide to a batch of molten metal in the tundish prior to casting.

14. A method as claimed in claim 3, wherein the process further comprises casting an initial length of strip from said batch of molten metal containing the sulphide addition, whereafter casting is continued without interruption by supply of further molten metal and without said sulphide addition, such further molten metal having a lower sulphur content than said batch, thereby casting a length of strip steel contiguous with said initial length but having a lower sulphur content.

15. A method as claimed in claim 11, wherein the process further comprises casting an initial length of strip from said batch of molten metal containing the sulphide addition, whereafter casting is continued without interruption by supply of further molten metal and without said sulphide addition, such further molten metal having a lower sulphur content than said batch, thereby casting a length of strip steel contiguous with said initial length but having a lower sulphur content.

16. A method as claimed in claim 12, wherein the process further comprises casting an initial length of strip from said batch of molten metal containing the sulphide addition, whereafter casting is continued without interruption by supply of further molten metal and without said sulphide addition, such further molten metal having a lower sulphur content than said batch, thereby casting a length of strip steel contiguous with said initial length but having a lower sulphur content.

17. A method as claimed in claim 13, wherein the process further comprises casting an initial length of strip from said batch of molten metal containing the sulphide addition, whereafter casting is continued without interruption by supply of further molten metal and without said sulphide addition, such further molten metal having a lower sulphur content than said batch, thereby casting a length of strip steel contiguous with said initial length but having a lower sulphur content.

18. A method as claimed in claim 3, wherein said refractory comprises graphitised alumina.

19. A method as claimed in claim 5, wherein said refractory comprises graphitised alumina.

20. A method as claimed in claim 6, wherein said refractory comprises graphitised alumina.

* * * * *